US007690750B2

(12) United States Patent
Kawatoko et al.

(10) Patent No.: US 7,690,750 B2
(45) Date of Patent: Apr. 6, 2010

(54) PRINTING APPARATUS AND PRINTING POSITION CONTROL METHOD

(75) Inventors: Norihiro Kawatoko, Kawasaki (JP); Masashi Hayashi, Sagamihara (JP); Toshiyuki Chikuma, Kawasaki (JP); Hidehiko Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 11/481,913

(22) Filed: Jul. 7, 2006

(65) Prior Publication Data

US 2007/0008370 A1 Jan. 11, 2007

(30) Foreign Application Priority Data

Jul. 8, 2005 (JP) ..... 2005-200156

(51) Int. Cl.
*B41J 29/393* (2006.01)

(52) U.S. Cl. ..... 347/19; 347/5; 347/9

(58) Field of Classification Search ..... 347/19, 347/5, 9, 12, 14, 15
See application file for complete search history.

(56) References Cited

U.S. PATENT DOCUMENTS 5,956,055 A 9/1999 Gibson et al.
6,142,604 A 11/2000 Kanda et al.
6,164,745 A 12/2000 Nagoshi et al.
6,364,447 B1 * 4/2002 Boleda et al. ..... 347/19
6,454,390 B1 9/2002 Takahashi et al.
6,474,767 B1 11/2002 Teshigawara et al.
6,532,026 B2 3/2003 Takahashi et al.
6,896,356 B1 5/2005 Otsuka et al.

FOREIGN PATENT DOCUMENTS

EP 0 674 993 A2 10/1995
JP 7-40551 A 2/1995
JP 7-81190 A 3/1995
JP 7-309007 A 11/1995
JP 11-240143 A 9/1999

* cited by examiner

*Primary Examiner*—Lam S Nguyen
(74) *Attorney, Agent, or Firm*—Fitzpatrick, Cella, Harper & Scinto

(57) ABSTRACT

A method of adjusting bidirectional registration to reduce negative effects on the image such as "banding" even if bidirectional registration includes a slight amount of displacement is provided. For that purpose, correction is applied to a first adjustment value for adjusting a bidirectional registration displacement in response to an extent of inclination of a printing head to obtain a second adjustment value. Then a bidirectional printing is performed with timing adjusted on the basis of the second adjustment value. As a result of that, even if there is a slight variation in an adjustment value of the bidirectional registration and the inclination of the printing head, the banding generated by this can be reduced as much as possible.

4 Claims, 21 Drawing Sheets

| INCLINATION | AMOUNT OF DISPLACEMENT OF BIDIRECTIONAL REGISTRATION | | | | | | |
|---|---|---|---|---|---|---|---|
| : 4 | -3 | -2 | -1 | 0 | 1 | 2 | 3 |
| BANDING | △ | × | △ | ○ | ○ | △ | △ |
| GRANULARITY | × | △ | ○ | △ | △ | × | × |

| INCLINATION | AMOUNT OF DISPLACEMENT OF BIDIRECTIONAL REGISTRATION | | | | | | |
|---|---|---|---|---|---|---|---|
| : 3 | -3 | -2 | -1 | 0 | 1 | 2 | 3 |
| BANDING | △ | × | △ | ○ | △ | × | × |
| GRANULARITY | × | △ | ○ | △ | △ | × | × |

| INCLINATION | AMOUNT OF DISPLACEMENT OF BIDIRECTIONAL REGISTRATION | | | | | | |
|---|---|---|---|---|---|---|---|
| : 2 | -3 | -2 | -1 | 0 | 1 | 2 | 3 |
| BANDING | △ | × | ○ | ○ | △ | △ | △ |
| GRANULARITY | × | △ | ○ | ○ | △ | × | × |

| INCLINATION | AMOUNT OF DISPLACEMENT OF BIDIRECTIONAL REGISTRATION | | | | | | |
|---|---|---|---|---|---|---|---|
| : 1 | -3 | -2 | -1 | 0 | 1 | 2 | 3 |
| BANDING | △ | △ | ○ | ○ | ○ | △ | △ |
| GRANULARITY | △ | ○ | ○ | ○ | △ | × | × |

| INCLINATION | AMOUNT OF DISPLACEMENT OF BIDIRECTIONAL REGISTRATION | | | | | | |
|---|---|---|---|---|---|---|---|
| : 0 | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION | AMOUNT OF DISPLACEMENT OF BIDIRECTIONAL REGISTRATION | | | | | | |
|---|---|---|---|---|---|---|---|
| : -1 | -3 | -2 | -1 | 0 | 1 | 2 | 3 |
| BANDING | △ | △ | ○ | ○ | ○ | △ | △ |
| GRANULARITY | × | × | △ | ○ | ○ | ○ | △ |

| INCLINATION | AMOUNT OF DISPLACEMENT OF BIDIRECTIONAL REGISTRATION | | | | | | |
|---|---|---|---|---|---|---|---|
| : -2 | -3 | -2 | -1 | 0 | 1 | 2 | 3 |
| BANDING | △ | △ | △ | ○ | ○ | × | △ |
| GRANULARITY | × | × | △ | ○ | ○ | △ | × |

| INCLINATION | AMOUNT OF DISPLACEMENT OF BIDIRECTIONAL REGISTRATION | | | | | | |
|---|---|---|---|---|---|---|---|
| : -3 | -3 | -2 | -1 | 0 | 1 | 2 | 3 |
| BANDING | × | × | △ | ○ | △ | × | △ |
| GRANULARITY | × | × | △ | △ | ○ | △ | × |

| INCLINATION | AMOUNT OF DISPLACEMENT OF BIDIRECTIONAL REGISTRATION | | | | | | |
|---|---|---|---|---|---|---|---|
| : -4 | -3 | -2 | -1 | 0 | 1 | 2 | 3 |
| BANDING | △ | △ | ○ | ○ | △ | × | △ |
| GRANULARITY | × | × | △ | △ | ○ | △ | × |

○: BANDING · GRANULARITY NOT EXIST
△: BANDING · GRANULARITY SLIGHTLY EXIST
×: BANDING · GRANULARITY EXIST

| INCLINATION : 0 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

○: BANDING·GRANULARITY NOT EXIST
△: BANDING·GRANULARITY SLIGHTLY EXIST
×: BANDING·GRANULARITY EXIST

| INCLINATION :1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | △ | ○ | ○ | ○ | △ |
| GRANULARITY | × | △ | ○ | ○ | ○ | △ | × |

○: BANDING·GRANULARITY NOT EXIST
△: BANDING·GRANULARITY SLIGHTLY EXIST
×: BANDING·GRANULARITY EXIST

| INCLINATION : 4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | △ | × | △ | ○ | ○ | △ |
| GRANULARITY | × | × | △ | ○ | △ | △ | × |

| INCLINATION : 3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | △ | × | △ | ○ | △ | × |
| GRANULARITY | × | × | △ | ○ | △ | △ | × |

| INCLINATION : 2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | △ | × | ○ | ○ | △ | △ |
| GRANULARITY | × | × | △ | ○ | ○ | △ | × |

| INCLINATION : 1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | △ | ○ | ○ | ○ | △ |
| GRANULARITY | × | △ | ○ | ○ | ○ | △ | × |

| INCLINATION : 0 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | ○ | ○ | ○ | △ | △ | △ |
| GRANULARITY | × | △ | ○ | ○ | ○ | △ | × |

| INCLINATION : -2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | × | △ | ○ |
| GRANULARITY | × | △ | ○ | ○ | △ | × | × |

| INCLINATION : -3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | × | △ | ○ | ○ | × | △ | ○ |
| GRANULARITY | × | △ | △ | ○ | △ | × | × |

| INCLINATION : -4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | ○ | ○ | △ | × | △ | ○ |
| GRANULARITY | × | △ | △ | ○ | △ | × | × |

○: BANDING · GRANULARITY NOT EXIST
△: BANDING · GRANULARITY SLIGHTLY EXIST
×: BANDING · GRANULARITY EXIST

FIG.5

| | HEAD INCLINATION | | |
|---|---|---|---|
| | EQUAL TO OR LESS THAN -1 | 0 | EQUAL TO OR MORE THAN +1 |
| AMOUNT OF CORRECTION | -1 | 0 | 1 |

FIG.11

| INCLINATION : 4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | × | △ | ○ | ○ | △ | △ |
| GRANULARITY | × | △ | ○ | △ | △ | × | × |

| INCLINATION : 3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | × | △ | ○ | △ | × | × |
| GRANULARITY | × | △ | ○ | △ | △ | × | × |

| INCLINATION : 2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | × | ○ | ○ | △ | △ | △ |
| GRANULARITY | × | △ | ○ | ○ | △ | × | × |

| INCLINATION : 1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | ○ | △ | △ |
| GRANULARITY | △ | ○ | ○ | ○ | △ | × | × |

| INCLINATION : 0 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | ○ | △ | △ |
| GRANULARITY | × | × | △ | ○ | ○ | ○ | △ |

| INCLINATION : -2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | △ | ○ | ○ | × | △ |
| GRANULARITY | × | × | △ | ○ | ○ | △ | × |

| INCLINATION : -3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | × | × | △ | ○ | △ | × | △ |
| GRANULARITY | × | × | △ | △ | ○ | △ | × |

| INCLINATION : -4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | △ | × | △ |
| GRANULARITY | × | × | △ | △ | ○ | △ | × |

○: BANDING·GRANULARITY NOT EXIST
△: BANDING·GRANULARITY SLIGHTLY EXIST
×: BANDING·GRANULARITY EXIST

FIG.12

| | HEAD INCLINATION | | | | | | | | | |
|---|---|---|---|---|---|---|---|---|---|---|
| | -5 | -4 | -3 | -2 | -1 | 0 | 1 | 2 | 3 | 4 | 5 |
| AMOUNT OF SHIFT | -1 | -1 | -1 | -1 | 0 | 0 | 0 | 1 | 1 | 1 | 1 |

FIG.13

| INCLINATION : 4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | △ | ○ | ○ | ○ | △ |
| GRANULARITY | × | △ | ○ | ○ | ○ | △ | × |

| INCLINATION : 0 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | ○ | ○ | ○ | △ | △ | △ |
| GRANULARITY | × | △ | ○ | ○ | ○ | △ | × |

| INCLINATION : -2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | △ | △ | × |

○: BANDING·GRANULARITY NOT EXIST
△: BANDING·GRANULARITY SLIGHTLY EXIST
×: BANDING·GRANULARITY EXIST

FIG.16

| | HEAD INCLINATION | | | | | | | | | |
|---|---|---|---|---|---|---|---|---|---|---|
| | -5 | -4 | -3 | -2 | -1 | 0 | 1 | 2 | 3 | 4 | 5 |
| AMOUNT OF SHIFT | 0 | 0 | 0 | 0 | -1 | 0 | 1 | 0 | 0 | 0 | 0 |

FIG.19

| INCLINATION : 4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : 1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | ○ | △ | △ |
| GRANULARITY | △ | ○ | ○ | ○ | △ | × | × |

| INCLINATION : 0 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -1 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | △ | △ | ○ | ○ | ○ | △ | △ |
| GRANULARITY | × | × | △ | ○ | ○ | ○ | △ |

| INCLINATION : -2 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -3 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | ○ | △ | × |

| INCLINATION : -4 | AMOUNT OF DISPLACEMENT OF BIDIRECTIONAL REGISTRATION | | | | | | |
|---|---|---|---|---|---|---|---|
| | -3 | -2 | -1 | 0 | 1 | 2 | 3 |
| BANDING | ○ | ○ | ○ | ○ | ○ | ○ | ○ |
| GRANULARITY | × | △ | ○ | ○ | △ | △ | × |

○: BANDING·GRANULARITY NOT EXIST
△: BANDING·GRANULARITY SLIGHTLY EXIST
×: BANDING·GRANULARITY EXIST

FIG.21

PRINTING APPARATUS AND PRINTING POSITION CONTROL METHOD

BACKGROUND OF THE INVENTION

1. Field of the Invention

The present invention relates to a printing apparatus which applies a printing agent on a printing medium from printing means with a plurality of printing elements arranged therein to form an image. In particular, the present invention relates to a method and a configuration for adjusting a printing position displacement of the printing element.

2. Description of the Related Art

A printing apparatus having a function of a printer, a copier or a facsimile, or a printing apparatus used as an output device of a composite electronic device including a computer or a word processor or a workstation prints an image on a printing medium such as a paper or a thin plastic sheet based on image information (including character information). Such printing apparatuses can be classified into an ink jet type printing apparatus, a wire dot type printing apparatus, a thermal type printing apparatus or a laser beam type printing apparatus according to the printing methods. Among the above, an ink jet type printing apparatus is the one that ejects ink from printing means (a printing head) to a printing medium for printing and has a number of excellent characteristics such as realizing high definition more easily, allowing high speed printing in excellent quietness and achieving a lower cost compared to the other printing methods. Therefore, the ink jet printing apparatuses are now generally used over a wide area from an office to personal use.

In general, each of the ink jet printing apparatuses is provided with a printing head in which a plurality of printing elements, each of which includes an ink ejection port and a liquid channel for supplying ink to the port, are integrated and arranged. Further, so as to correspond to color images, each of the ink jet printing apparatuses is equipped with such printing heads of a plurality of colors.

The ink jet printing apparatuses are generally classified into a serial type printing apparatus and a line type printing apparatus from the difference of the printing operations. In the serial type printing apparatus, main print scanning in which a printing head moves and scans a printing medium to form an image, and sub-scanning in which the printing medium is carried in a direction intersecting the main print scanning are intermittently repeated to form an image. On the other hand, in the line type printing apparatus, a printing head in which a number of printing elements in response to a printing width of a printing medium are arranged is fixedly disposed, and while printing by the printing head is carried out, the printing medium moves in a direction different from an arrangement direction of the printing element at a predetermined speed, and thus an image is formed.

The line type printing apparatus can print at a high speed but the size of the device itself is likely to be large. On the other hand, the serial type printing apparatus can correspond to printing mediums of various sizes with a small printing head, and by changing the number of printing scanning or a main scanning direction to the same image area, correspond to various printing speeds and image quality in response to the user's preference. Thus, in these years, the serial type ink jet printing apparatuses are widely used especially for personal use.

However, the serial type ink jet printing apparatus includes problems peculiar to itself. In the serial type ink jet printing apparatus, main print scanning in which the printing head which ejects ink moves and scans the printing medium and sub-scanning in which the printing medium is carried in a direction intersecting the main print scanning are intermittently repeated to form an image on the printing medium. When there is an intention to output an image at as high a speed as possible, bidirectional printing to perform the main print scanning described above bidirectionally is generally adopted. At this time, when a printing position displacement (hereinafter also referred to as a bidirectional registration displacement) is included in forward scanning and backward scanning of the main print scanning, a negative effect on the image as follows is identified in some cases.

FIGS. 1A to 1D are drawings for explaining a bidirectional registration displacement phenomenon and the negative effect. Each of FIG. 1A and FIG. 1B shows the case of printing a ruled line pattern. Here, a reference numeral 501 shown in a solid line denotes a ruled line printed in the forward scanning and a reference numeral 502 shown in a broken line denotes a ruled line printed in the backward scan. When the bidirectional registration is not deviated, the ruled line 501 printed in the forward pass and the ruled line 502 printed in the backward pass are printed on the same straight line to form a straight ruled line pattern as in FIG. 1B. As opposed to this, when the bidirectional registration is deviated, the ruled line 501 printed in the forward pass and the ruled line 502 printed in the backward pass are printed at positions separated from each other, which makes the ruled line pattern into cut pieces as in FIG. 1A.

Moreover, when multi-pass printing is adopted and a same image area of the printing medium is divided in the forward scanning and backward scanning for printing, another problem is generated. Each of FIG. 1C and FIG. 1D show the case where a uniform pattern is printed in the multi-pass printing. Here, a reference numeral 503 shows a dot printed in the forward scanning and a reference numeral 504 shows a dot printed in the backward scanning. When the bidirectional registration is not deviated, the dots 503 printed in the forward pass and the dots 504 printed in the backward pass maintain a complementary relationship each other and are dispersed in a preferable state as in FIG. 1D to be printed. As opposed to this, when the bidirectional registration is deviated, the complementary relationship between the dots 503 printed in the forward pass and the dots 504 printed in the backward pass becomes incomplete, and the printing is performed in the state in which dot density variations are deviated as in FIG. 1C. The image as in FIG. 1C is perceived visually as image granularity, which is a factor of the image deterioration.

In order to solve the problems of the bidirectional registration displacement as described above, a method and a configuration to adjust bidirectional registration in an ink jet printing apparatus which performs the bidirectional printing have been devised and implemented (for instance, refer to Japanese Patent Application Laid-Open No. 7-81190).

However, according to the results obtained through the diligent examination by the inventors, even if the method described in Japanese Patent Application Laid-Open No. 7-81190 is adopted to adjust the bidirectional registration, when a slight inclination is included in the printing head, it has been confirmed that not only are the problems not solved sufficiently but also there is a case where a new negative effect is generated at the same time.

FIG. 2 is a drawing for explaining a printing head which has inclination. Here, the case of printing a ruled line extended in the sub-scanning direction is shown. When the printing head is inclined, even if the bidirectional registration is adjusted, the ruled line printed in each of print scanning is inclined. The printing state in the case where the bidirectional registration is adjusted with the use of such a printing head will be explained as follows.

FIGS. 3A and 3B are drawings, each showing a printing state in the case where the multi-pass printing is carried out with the use of a printing head which is not inclined. In the example, a serial type ink jet printing apparatus which forms an image at the printing density of 1200 dpi (dot/inch) is used and it is possible to adjust the bidirectional registration by 1 pixel, in other words, by 1/1200 inch. In FIG. 3A, an area shown in the pattern of a reference numeral 601 denotes an image of 1 pixel width printed in the forward scanning and an area shown in the pattern of a reference numeral 602 denotes an image of 1 pixel width printed in the backward scanning. In the example, a multi-pass (two-pass) printing is adopted, and after one print scanning is performed by the forward scanning or backward scanning, the printing head is moved by half the printing width in the sub-scanning direction to the printing medium.

When an amount of displacement of the bidirectional registration is 0, there is no displacement between the image 601 printed in the forward scanning and the image 602 printed in the backward scan, and both of the images overlap on the same straight line. As the amount of displacement of the bidirectional registration is gradually increased, the image 601 printed in the forward scanning and the image 602 printed in the backward scanning are gradually separated from each other.

FIG. 3B is a drawing for explaining an extent of each of image quality items in the case where the amount of displacement of the bidirectional registration is gradually changed as shown in FIG. 3A. Here, as the image quality items, "banding" and "granularity" are listed. In the present specification, "granularity" shows a sense of roughness which is increased corresponding to an extent of uneven of dot density variations in a uniform pattern as explained in FIG. 1C. For instance, the granularity in FIG. 1C is inferior, compared to that in FIG. 1D. On the other hand, "banding" means a non-uniform state to the sub-scanning direction perceived in the case where a state of dot density variations is changed in the sub-scanning direction. The granularity and banding are based on the causes mentioned above and recognized as items deteriorating the image quality visually. The evaluation shown in FIG. 3B is a result obtained through visual recognition by the inventors.

In FIG. 3B, when the amount of displacement of the bidirectional registration is 0, dots printed in the forward scanning and dots printed in the backward scanning are complemented in a preferable state for each other as in FIG. 1D. Because of that, the uneven of dot density variations is not generated and both of the banding and granularity are not recognized. When the amount of displacement of the bidirectional registration is gradually increased, the complementary relationship between the dots printed in the forward scanning and the dots printed in the backward scanning becomes insufficient, and the extent becomes more remarkable as the amount of displacement is larger. As a result of that, as the amount of displacement of the bidirectional registration becomes larger, the granularity is more deteriorated. In the case of the example, however, even in a deteriorated state, there is no factor of fluctuation of the extent of granularity to the sub-scanning direction. Thus, banding is maintained in an excellent state regardless of the amount of displacement of the bidirectional, registration.

On the other hand, FIG. 4A and FIG. 4B are drawings each showing, as in FIG. 3A and FIG. 3B, a printing state when the multi-pass printing is performed with the use of the printing head which is inclined. Here, the state in which the displacement of approximately 1 pixel, that is, nearly 1/1200 inch is included between a leading end and a trailing end of the printing head in the sub-scanning direction is shown. As shown in FIG. 4A, when the amount of displacement of the bidirectional registration is 0, even if there is the inclination, an area printed in the forward scanning and an area printed in the backward scanning are overlapped with each other almost preferably in the main scanning direction. Therefore, a nearly excellent complementary relationship in dots printed in the forward pass and dots printed in the backward pass is realized and thus, granularity is not perceived. Also, the state of dot density variations as described above does not fluctuate to the sub-scanning direction and thus, banding is also maintained in an excellent state.

On the other hand, the state in the case where the bidirectional registration displacement is generated will be explained on the basis of the case where the amount of displacement is +2. Here, a reference numeral 701 shows an image area printed in a first print scanning, a reference numeral 702 shows an image area printed in a second print scanning and a reference numeral 703 is an image area printed in a third print scanning. The image areas 701 and 703 are printed in the forward scanning and the image area 702 is printed in the backward scanning. The bidirectional registration is deviated by 2 pixels between the forward scanning and the backward scanning, and thus only the image area 702 by the second print scanning is formed at the position separated from the image areas 701 and 703. However, in the case, the distance between the image area printed in the forward direction and the image area printed in the backward direction is different, depending on the areas on the printing media. That is, while the distance between the image area 701 and the image area 702 is relatively shorter in the area A, the distance between the image area 703 and the image area 702 is relatively longer in the area B. When a uniform pattern is printed in such a state, a state of complementarity of dots, in other words, a state of density variations is different between the area A and the area B. As a result of that, two kinds of areas thereof are repeated in the sub-scanning direction, which generates banding to be recognized.

FIG. 4B is a drawing for explaining the extent of banding and granularity when the amount of displacement of the bidirectional registration is gradually changed as in FIG. 4A. In the drawing, when the amount of displacement of the bidirectional registration is 0, the dots printed in the forward scanning and the dots printed in the backward scanning are nearly in the state of complementarity. Because of that, the uneven of dot density variations itself is not generated and both of banding and granularity are not recognized. When the amount of displacement of the bidirectional registration is gradually increased, the complementary relationship between the dots printed in the forward scanning and the dots printed in the backward scanning becomes insufficient, and the extent becomes more remarkable as the amount of displacement is larger. As a result of that, as the amount of displacement of the bidirectional registration becomes larger, the granularity is more deteriorated. Also, in the state in which the printing head is inclined as in the example, areas of each of which a state of density variations is different as in the area A and the area B explained in FIG. 4A are arranged alternately in the sub-scanning direction and thus, it is likely to deteriorate the extent of banding.

Such banding is a negative effect which is generated compositely from two factors of the bidirectional registration displacement and head inclination. The inventors, as a result of the diligent examination, have confirmed that even if there is only a little bidirectional registration displacement and head inclination respectively, a negative effect by the banding described above is noticeable earlier than the direct negative effects such as granularity and ruled line displacement. That is, referring to FIG. 4B again, when the amount of displacement of the bidirectional registration is −1, even if the granularity is not deteriorated so much, the banding is already deteriorated to the extent where it is recognized.

Further, what is noted is that whether the amount of displacement of the bidirectional registration is extended in a positive direction or a negative direction, the granularity is deteriorated by approximately the same extent, but as for the banding, a degree of deterioration thereof is different depending on the positive and negative directions. The inventors has focused on the point and confirmed how the state of banding as shown in FIG. 4B is changed when a degree of inclination of the printing head is further fluctuated.

FIG. 5 is a drawing showing a result of the examination mentioned above. Here, the result obtained when the inclination of the printing head is set to ±4 is shown as in FIG. 3B and FIG. 4B. As in the printing head explained in FIG. 4A, an inclination of the extent where an approximately 1 pixel displacement is generated between the leading end and the trailing end of the printing head is here referred to as "inclination 1". And, the states in which the direction is the same as the above and the amount of displacement between the leading end and the trailing end is increased by 1 pixel are shown respectively as "inclination +2", "inclination +3" and "inclination +4". On the other hand, the states in which the direction of the inclination is reversed are shown as "inclination −1" to "inclination −4".

As is apparent also in the drawing, even if the amount of displacement of the bidirectional registration is approximately ±1 pixel, when there is an inclination, a negative effect by banding is identified. For instance, when the inclination is ±1, it is determined as approximately "Δ" and when the amount of inclination is further increased, it is determined as approximately "x".

Until now, for the correction of the bidirectional registration, a plurality of patterns changed in relation to the amount of displacement of the bidirectional registration have been printed simultaneously while the amount of displacement is changed step by step. Then, the plurality of pattern printed has been confirmed through visual inspection by the user or detection means such as a sensor to select a pattern of the least amount of displacement of the bidirectional registration. Furthermore, the print timing at which the selected pattern was printed have been set, by which the bidirectional registration have been generally adjusted. However, in the bidirectional registration adjustment pattern printed in such a method, the extent of the banding generated by the effect of the head inclination can not be identified.

On the other hand, in an ink jet printing apparatus allowing the high resolution image output these days, a bidirectional registration displacement of approximately ±1 pixel is generated suddenly or steadily because of various factors in some cases. Moreover in the adjustment of the bidirectional registration, in many cases, a displacement of approximately ±1 pixel is in a range where it is accepted as an error. Therefore, in the ink jet printing apparatus, it is strongly desired that even when the amount of displacement of the bidirectional registration is approximately ±1 pixel, the image is the one such that a large negative effect is not visually recognized so much.

However, as explained above, when the printing head is inclined, even when the bidirectional registration displacement is approximately ±1 pixel, the banding is easily identified, which as a result deteriorates the image quality. In particular, as visual characteristics of human beings, a band-shaped repetition as shown in banding rather than uniform roughness shown in granularity is felt to be uncomfortable in more cases. Also from such a reason, reducing the banding described above is a very important challenge.

SUMMARY OF THE INVENTION

The present invention has been made in view of the foregoing problems and has an object of providing a method of adjusting a bidirectional registration such that a negative effect on an image such as "banding" is reduced as much as possible even when a printing head is slightly inclined.

The first aspect of the present invention is a printing apparatus for forming an image by bidirectional scanning of a printing element array in a direction intersecting a conveying direction of a printing medium, the printing element array including a plurality of printing elements arranged in the conveying direction each of which applies a coloring agent on the printing medium, comprising: means for obtaining an amount of displacement between a printing position of forward scanning and a printing position of backward scanning; means for setting a first adjustment value to adjust timing at which the printing elements apply the coloring agent in the bidirectional scanning as to reduce the amount of the displacement; means for obtaining an extent of inclination of the printing element array to the conveying direction; means for obtaining a second adjustment value by correcting the first adjustment value in response to the extent of the inclination; and means for adjusting the timing at which the printing elements apply the coloring agent in the bidirectional scanning based on the second adjustment value to form an image.

The second aspect of the present invention is a printing apparatus for forming an image by bidirectional scanning of a printing element array in a direction intersecting a conveying direction of a printing medium, the printing element array including a plurality of printing elements arranged in the conveying direction each of which applies a coloring agent on the printing medium, comprising: means for obtaining an amount of displacement between a printing position of forward scanning and a printing position of backward scanning; means for setting a first adjustment value to adjust timing at which the printing elements apply the coloring agent in the bidirectional scanning as to reduce the amount of the displacement; means for obtaining an amount of inclination of the printing element array to the conveying direction; means for setting an inclination adjustment value to adjust timing at which the printing elements apply the coloring agent in the bidirectional scanning as to reduce the amount of inclination; means for obtaining a second adjustment value by correcting the first adjustment value in response to the amount of inclination; and means for adjusting the timing at which the printing elements apply the coloring agent in the bidirectional scanning based on the inclination adjustment value and the second adjustment value to form an image.

The third aspect of the present invention is a printing position control method of a printing apparatus for forming an image by bidirectional scanning of a printing element array in a direction intersecting a conveying direction of a printing medium, the printing element array including a plurality of printing elements arranged in the conveying direction each of which applies a coloring agent on the printing medium, comprising the steps of: obtaining an amount of displacement between a printing position of forward scanning and a printing position of backward scanning in the bidirectional scanning; setting a first adjustment value to adjust timing at which the printing elements apply the coloring agent in the bidirectional scanning as to reduce the amount of displacement; obtaining an extent of inclination of the printing element array to the conveying direction; obtaining a second adjustment value which is obtained by correcting the first adjustment value in response to the extent of the inclination; and adjusting the timing at which the printing elements apply the coloring agent in the bidirectional scanning based on the second adjustment value to form an image.

The forth aspect of the present invention is a printing position control method of a printing apparatus for forming an image by bidirectional scanning of a printing element array in a direction intersecting a conveying direction of a printing medium, the printing element array including a plurality of printing elements arranged in the conveying direction each of which applies a coloring agent on the printing medium, comprising the steps of: obtaining an amount of displacement between a printing position of forward scanning and a printing position of backward scanning in the bidirectional scanning; setting a first adjustment value to adjust timing at which the printing elements apply the coloring agent in the bidirectional scanning as to reduce the amount of the displacement; obtaining an amount of inclination of the printing element array to the conveying direction; setting an inclination adjustment value to adjust the timing at which the printing elements apply the coloring agent in the bidirectional scanning as to reduce the amount of inclination; obtaining a second adjustment value which is obtained by correcting the first adjustment value in response to the amount of inclination; and adjusting the timing at which the printing elements apply the coloring agent in the bidirectional scanning based on the inclination adjustment value and the second adjustment value to form an image.

The above and other objects, effects, features and advantages of the present invention will become more apparent from the following description of embodiments thereof taken in conjunction with the accompanying drawings.

BRIEF DESCRIPTION OF THE DRAWINGS

FIG. 5 is a diagram showing a state of each of banding and granularity when a degree of the inclination of a printing head is fluctuated;

FIG. 11 is a diagram showing an amount of correction applied in response to the inclination of the printing head;

FIG. 12 is a diagram for explaining an extent of each of "banding" and "granularity" when an image is printed in the embodiment 1;

FIG. 13 is a diagram showing another example of the correction table according to the embodiment 1;

FIG. 16 is a diagram showing a state of each of banding and granularity when a degree of inclination of a printing head is changed per pixel while an inclination correction is performed;

FIG. 19 is a diagram showing an amount of correction applied in response to an inclination of the printing head;

FIG. 21 is a diagram for explaining an extent of each of banding and granularity when an image is printed in the embodiment 2.

DETAILED DESCRIPTION OF PREFERRED EMBODIMENTS

Embodiments of the present invention will be explained on the basis of the drawings as follows. (Basic Configuration of Ink Jet Printing apparatus)

Figure 6:
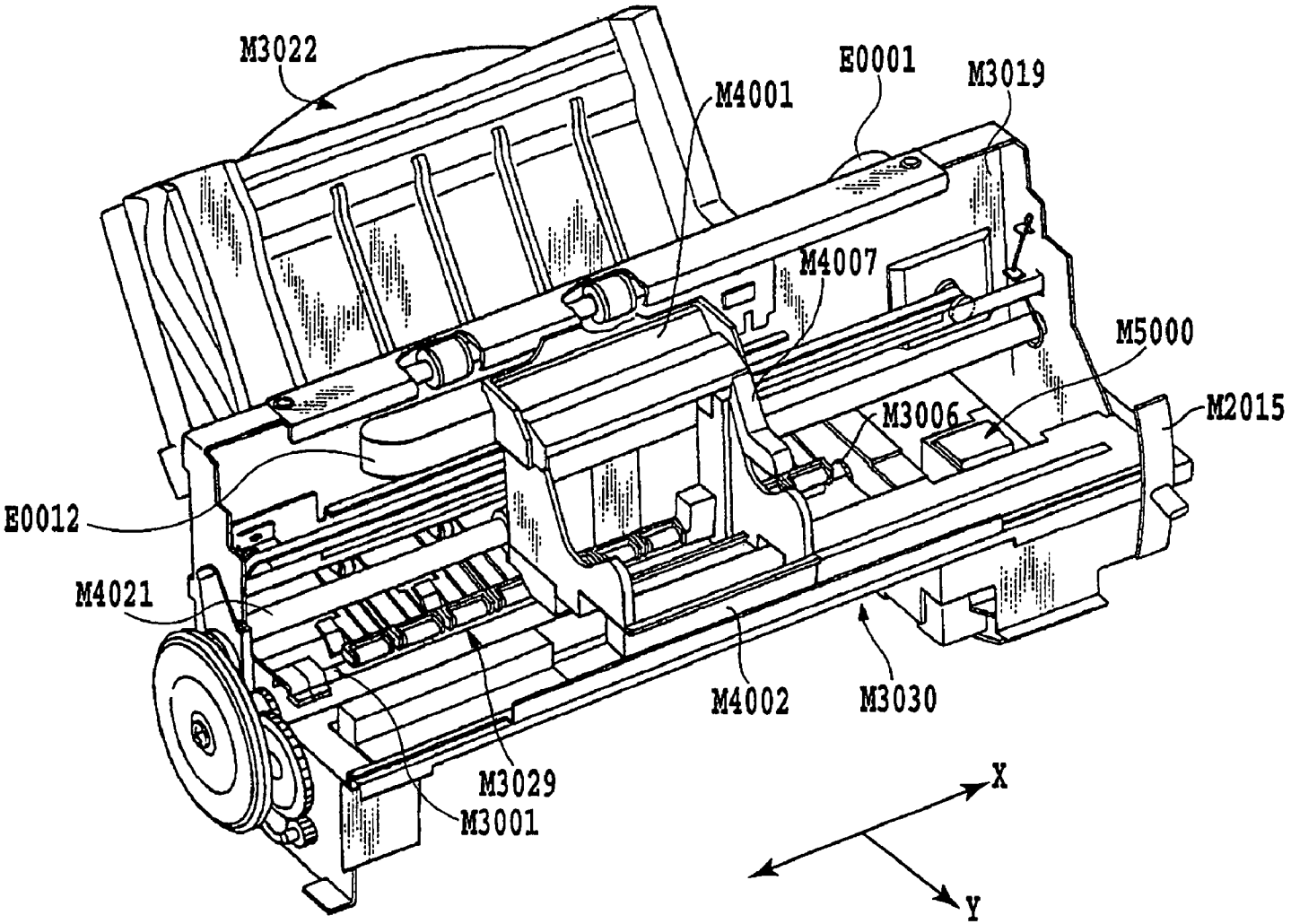
FIG. 6 is a schematic configuration view for explaining an essential part of an ink jet printing apparatus to which the present invention is applicable.

FIG. 6 is a schematic configuration view for explaining an essential part of an ink jet printing apparatus to which the present invention can be applied. In FIG. 6, a chassis M3019 which is placed in an outside case member of the printing apparatus is configured with a plurality of plate-shaped metal members having predetermined rigidity to form a framework of the printing apparatus and hold each printing operation mechanism as shown below. An automatic feeder M3022 automatically feeds a paper (a printing medium) into a main body of the printing apparatus. A carrier M3029 guides printing mediums fed sheet by sheet from the automatic feeder M3022 to a predetermined printing position by the rotation of an LF roller 3001 and also further guides from the printing position to a discharging unit M3030. The arrow Y indicates a direction of conveying the printing medium (a sub-scanning direction). The printing medium positioned in the printing position is desirably printed by a printing unit. In addition, to the printing unit, a recovery process is carried out by a recovery unit M5000. A reference numeral M2015 shows a lever to adjust a distance between an ejection port surface of the printing head and the printing medium in a stepwise fashion, that is, a head-paper gap adjustment lever and a reference numeral M3006 shows a bearing of the LF roller M3001.

In the printing unit, a carriage M4001 is moved in a main scanning direction of the arrow X in accordance with the drive of a carriage motor E0001 under the guide and support of a carriage shaft M4021. Moreover, in the carriage M4001, an ink jet type printing head H1001 which ejects ink (refer to FIG. 7) is removably mounted.

Figure 7:
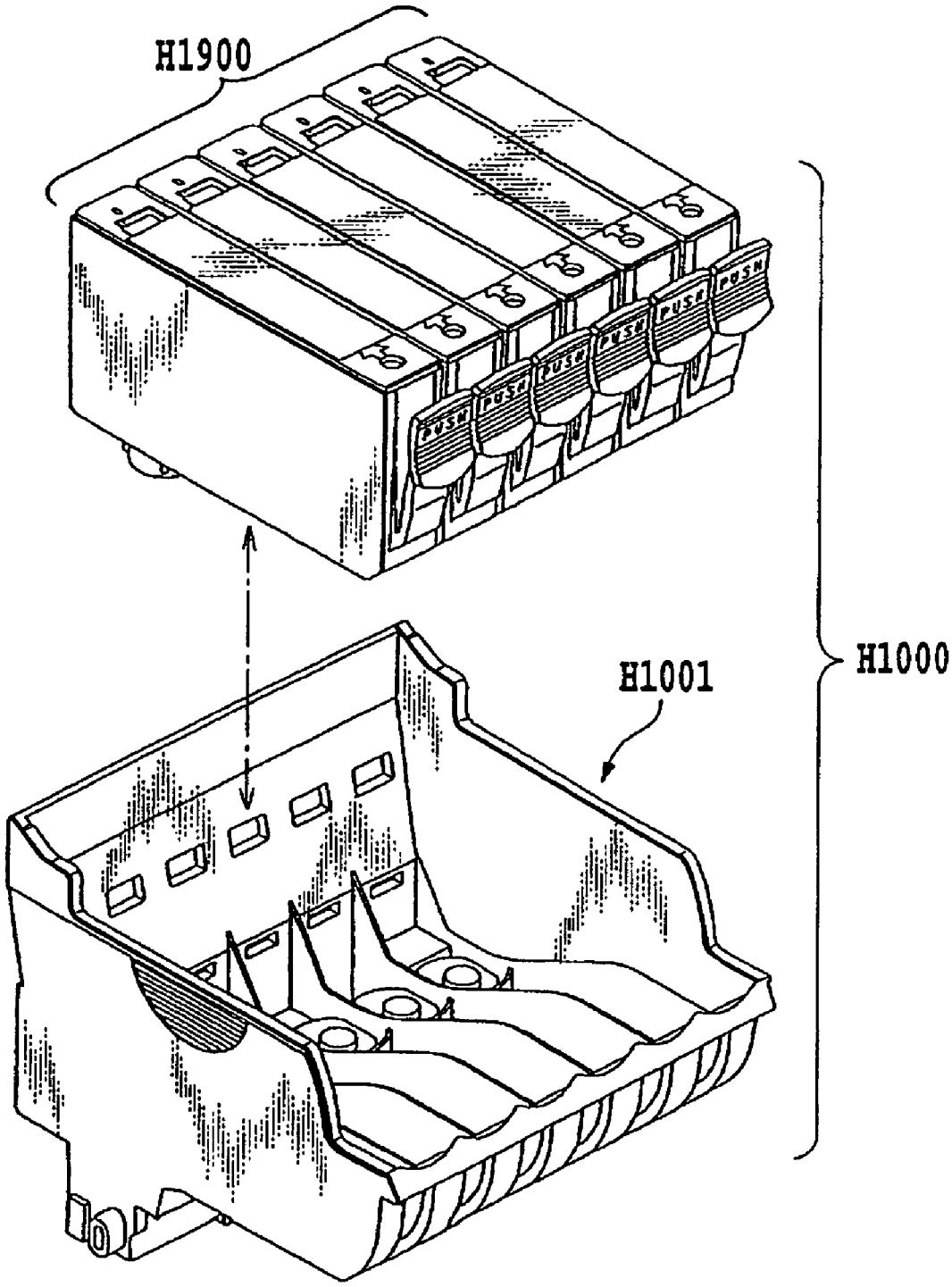
FIG. 7 shows the attachment of an ink tank of each of a plurality of colors to the printing head.

FIG. 7 shows the attachment of an ink tank H1900 of each of a plurality of colors to the printing head H1001. In the embodiment, the printing head cartridge H1000 includes the printing head H1001 and an ink tank H1900 of each of six colors. In the embodiment, in order to make it possible to perform the photographic color printing with high image quality, an ink tank of each color of black, light cyan, light magenta, cyan, magenta and yellow is independently prepared. Each of the ink tanks H1900 is attached to/detached from the printing head H1001 and supplies ink which is consumed according to the printing to the printing head.

Then, FIG. 6 will be described again. When the printing head cartridge H1000 is attached to the carriage M4001, a head drive signal which is necessary for the printing is transmitted to the printing head via a flexible cable E0012 connected to a main substrate (not shown). Any methods for the ink ejection by each individual printing element disposed in the printing head may be applicable, but in the configuration of the printing head of the embodiment, an electrothermal transducer element is disposed in each individual printing element. It is arranged that when a drive signal as a voltage pulse is applied to the electrothermal transducer element, the electrothermal transducer element generates heat rapidly and inside the ink in contact with the element, film boiling occurs to develop a bubble and by the growing energy of the bubble, the ink is ejected from the ejection port.

The recovery unit M5000 includes a cap (not shown) to cap a surface of the ink ejection port of the printing head H1001. The cap may be connected to a suction pump which can introduce a negative pressure therein. In this case, a negative pressure is introduced into the cap covering the ink ejection port of the printing head H1001, by which ink from the ink ejection port is sucked and discharged. And thus, it is possible to carry out a recovery process (also referred to as a suction recovery process) for maintaining an excellent state of ink ejection of the printing head H1001. Moreover, the ink which does not contribute to the image printing is ejected from the ink ejection port to the inside of the cap, by which a recovery process can be performed to maintain an excellent state of ink ejection of the printing head H1001.

Further, the carriage M4001 includes a carriage cover M4002 to guide the printing head H1001 at a predetermined attachment position. Furthermore, the carriage M4001 includes a head set lever M4007 which is engaged in a tank holder of the printing head H1001 and set the printing head H1001 at a predetermined attachment position. The head set lever M4007 is provided rotatably with respect to a head set lever shaft located at the upper part of the carriage M4001 and includes a spring-urged head set plate (not shown) at an engagement part which is engaged in the printing head H1001. By the spring force, the head set lever M4007 presses and simultaneously attaches the printing head H1001 to the carriage M4001.

Figure 8:
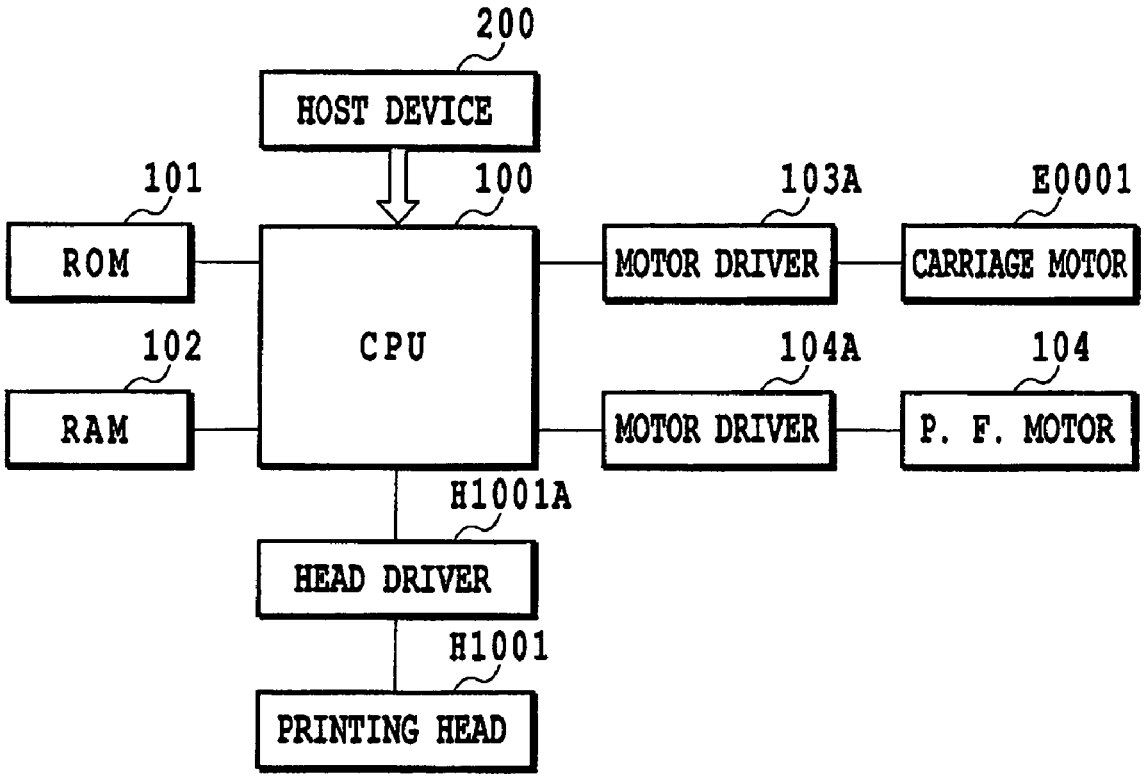
FIG. 8 is a block diagram for explaining a configuration of a control system in the ink jet printing apparatus to which the present invention is applicable.

FIG. 8 is a block diagram for explaining a configuration of a control system in the printing apparatus as described above. In the drawing, a CPU 100 performs control processing of an operation of the ink jet printing apparatus in the embodiment, data processing or the like. A ROM 101 stores a program of a processing procedure thereof or the like and further, a RAM 102 is used as a work area for the execution of the processing. The CPU 100 supplies a head driver H1001A with drive data (print data) and a drive control signal (a heat pulse signal) for applying an electrothermal transducer element to perform the ink ejection from the printing head H1001. The CPU 100 controls the carriage motor E0001 to drive the carriage M4001 in the main scanning direction via a motor driver 103A and also, controls a P. F motor 104 to convey the printing medium in the sub-scanning direction via a motor driver 104A.

When the printing is performed by the ink jet printing apparatus with the above configuration, firstly, the CPU 100 temporarily stores the print data which is input through an external I/F from a host device 200 in a print buffer which is provided in the RAM 102. Then, while the printing head H1001 along with the carriage M4001 is moved in the main scanning direction by the carriage motor E0001, the drive signal based on the print data is transmitted to the head driver H1001A. When the first main print scanning is finished, the CPU 100 conveys by a predetermined amount the printing medium via the P. F motor 104. The main print scanning and the conveying operation described above are repeated and thus, the print data stored in the print buffer is printed to the printing medium in sequence.

With the use of the ink jet printing apparatus having the configuration described above, a method of adjusting the bidirectional registration characterized by the present invention will be explained as some embodiments in detail as follows.

Embodiment 1

Figure 9:
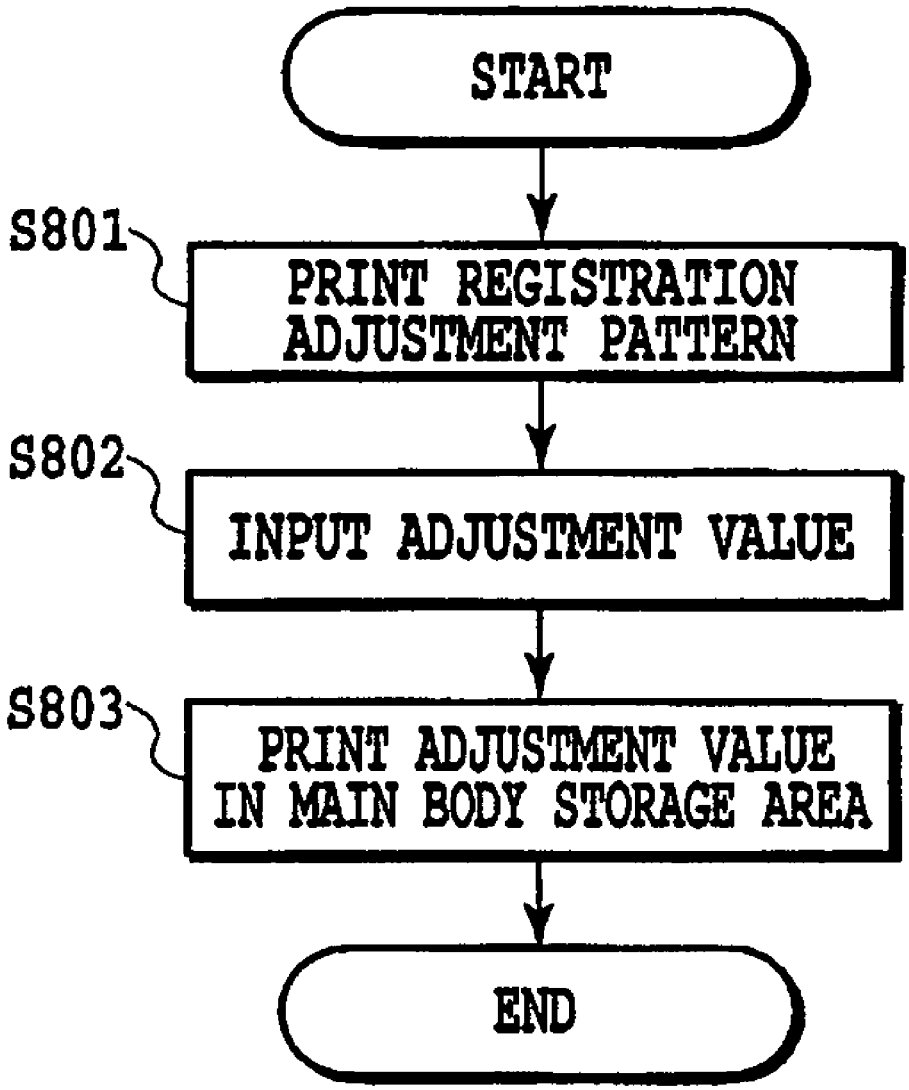
FIG. 9 is a flow chart for explaining each process when a bidirectional registration adjustment mode according to an embodiment 1 of the present invention is carried out.

FIG. 9 is a flow chart for explaining each process when a bidirectional registration adjustment mode of the embodiment is carried out. When the process is started, firstly in step S801, the CPU 100 reads pattern data for bidirectional registration adjustment which is stored in the ROM 101 to output this to the printing medium through various types of drive means. The adjustment pattern printed at the time is arranged that while the amount of displacement of the bidirectional registration is fluctuated step by step, a plurality of patterns are simultaneously printed in parallel, which enables the user to select an optimum pattern from the plurality of patterns. Moreover, in the pattern of the embodiment, a pattern to distinguish an inclination direction of the printing head is also printed simultaneously.

In the following step S802, the user inputs a selected pattern and a determined inclination direction of the printing head. An input method may be a method of the direct input to the main body of the printing apparatus by some sort of input device or a method of the input via the host device 200.

Further, in step S803, the CPU 100 stores the information which is input by the user in the ROM 101. This is the end of the processing.

Figure 10:
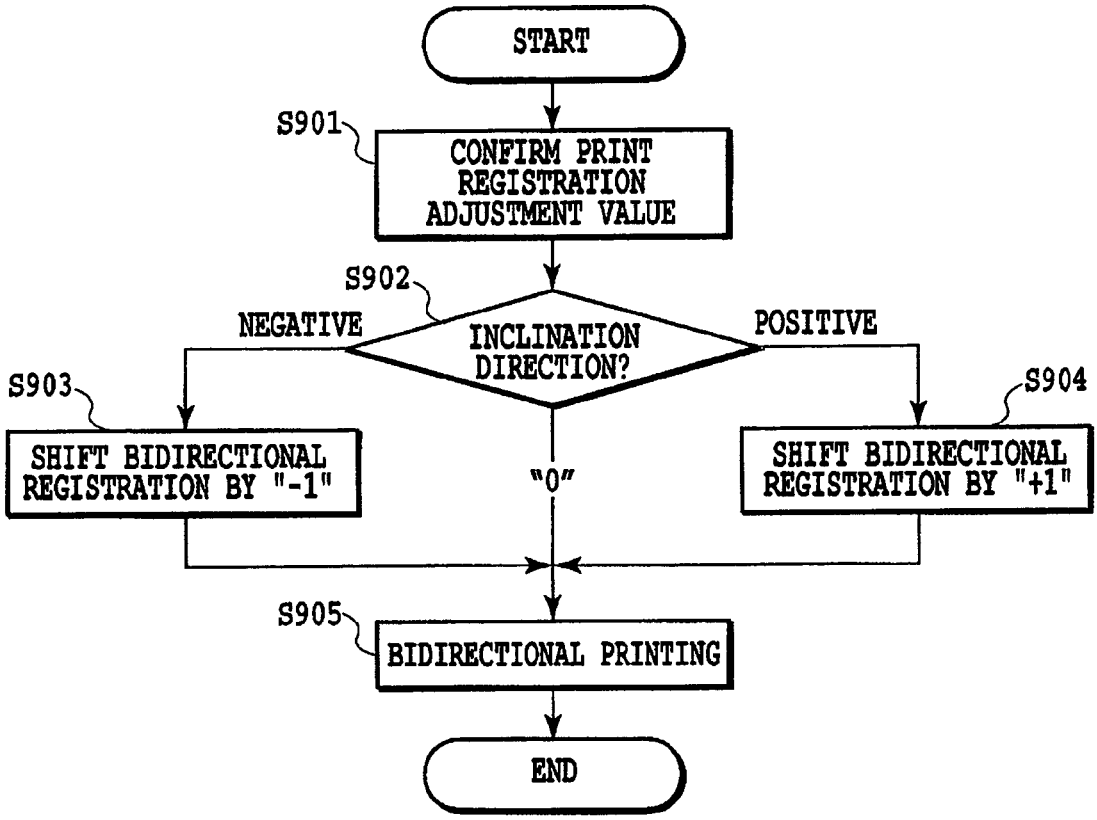
FIG. 10 is a flow chart for explaining a process of adjusting a bidirectional registration in the embodiment 1.

FIG. 10 is a flow chart for explaining a process of adjusting a bidirectional registration based on the information stored in the ROM 101 prior to the actual image printing. When a printing instruction by the host device 200 is input, the CPU 100 firstly obtains an adjustment value of the bidirectional registration stored in the ROM 101 to set (step S901).

Then, the step proceeds to S902. In S902, whether an inclination direction of the printing head which is attached at the moment is positive or negative is determined from the information stored in the ROM 101 and according to the determination, the adjustment value set in step S901 is corrected.

FIG. 11 is a diagram showing an amount of correction applied in response to the inclination direction of the printing head. That is, in the embodiment, when the inclination is 0, the preset adjustment value of the bidirectional registration is not corrected and the step proceeds to step S905. On the contrary, when the inclination direction is positive, the step proceeds to step S904. In S904, the value +1 is added to the adjustment value of the bidirectional registration set in step S901. Furthermore, when the inclination direction is negative, the step proceeds to step S903. In step S903, the value −1 is added to the adjustment value of the bidirectional registration set in step S901.

In step S905, according to the adjustment value set in step S902 to step S904, the bidirectional printing of the actual image is carried out. This is the end of the processing.

FIG. 12 is a diagram for explaining an extent of each of banding and granularity when an image is printed in the embodiment 1 in comparison with that of FIG. 5. According to the embodiment, it is clear that compared to the result shown in FIG. 5, the extent of banding is totally improved especially in the range where each of the amount of displacement of the bidirectional registration and the amount of inclination of the printing head is +1 to −1. As described above, it is profitable that in the vicinity of the regular adjustment value, that is, in the area where each of the amount of displacement of the bidirectional registration and the amount of inclination of the printing head is ±1 pixel, image quality is stable.

By the way, in the above, the adjustment of the bidirectional registration to reduce the occurrence of banding in a more positive manner has been explained on the assumption that the banding which is periodically repeated is a larger image problem than granularity. In other words, when only the granularity is taken into consideration, it is preferable that the adjustment value obtained in the bidirectional registration adjustment mode is applied without change in the actual image printing, but in order to reduce the occurrence of banding, the amount of adjustment is corrected. However, depending on various conditions such as the kind of printing medium or the kind of printing image, there may be a case where the granularity is considered as a larger problem than the banding. In such a case, a correction table in which the granularity is regarded as more important, which is different from the table shown in FIG. 11, may be applied.

FIG. 13 is a diagram showing another example of the correction table according to the embodiment. Here, the amount of correction relative to the bidirectional registration is arranged to be changed according to not only whether the inclination of the printing head is positive or negative but also the value. In the range where the amount of inclination of the printing head is ±1 pixel, the granularity is considered to be more important than the banding and thus, the obtained adjustment value is not corrected. And, from the time when the inclination of the printing head is made further larger and it becomes impossible to ignore a negative effect by the banding (the inclination is ±2 pixels in this example), a correction is applied.

As described above, according to the embodiment, the amount of adjustment of the bidirectional registration is corrected in response to the extent of inclination of the printing head and thus, it becomes possible to totally reduce image deterioration factors including the banding and the granularity and output an image of higher quality in the bidirectional printing.

Embodiment 2

A second embodiment of the present invention will be explained in the following. In the embodiment, the printing apparatus shown in FIG. 6 and FIG. 8 is also applied, but furthermore in the embodiment, the printing apparatus includes means and a configuration possibly to detect a pattern automatically and set an adjustment value without depending on the visual determination by the user.

Figure 1A:
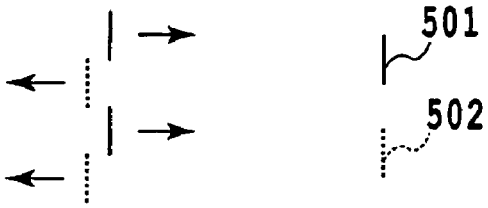
FIGS. 1A to 1D are diagrams for explaining a bidirectional registration displacement phenomenon and a negative effect thereof.
Figure 1B:
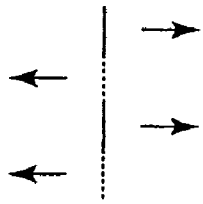
Figure 1C:
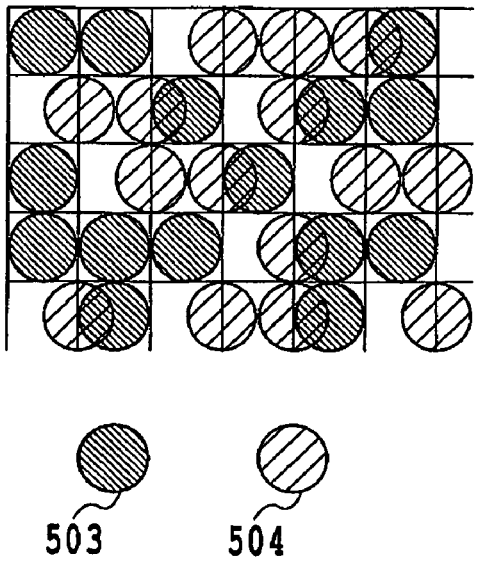
Figure 1D:
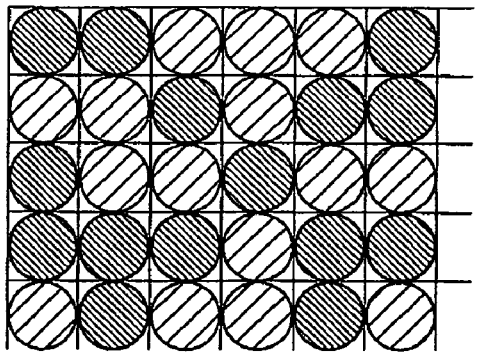
Figure 2:
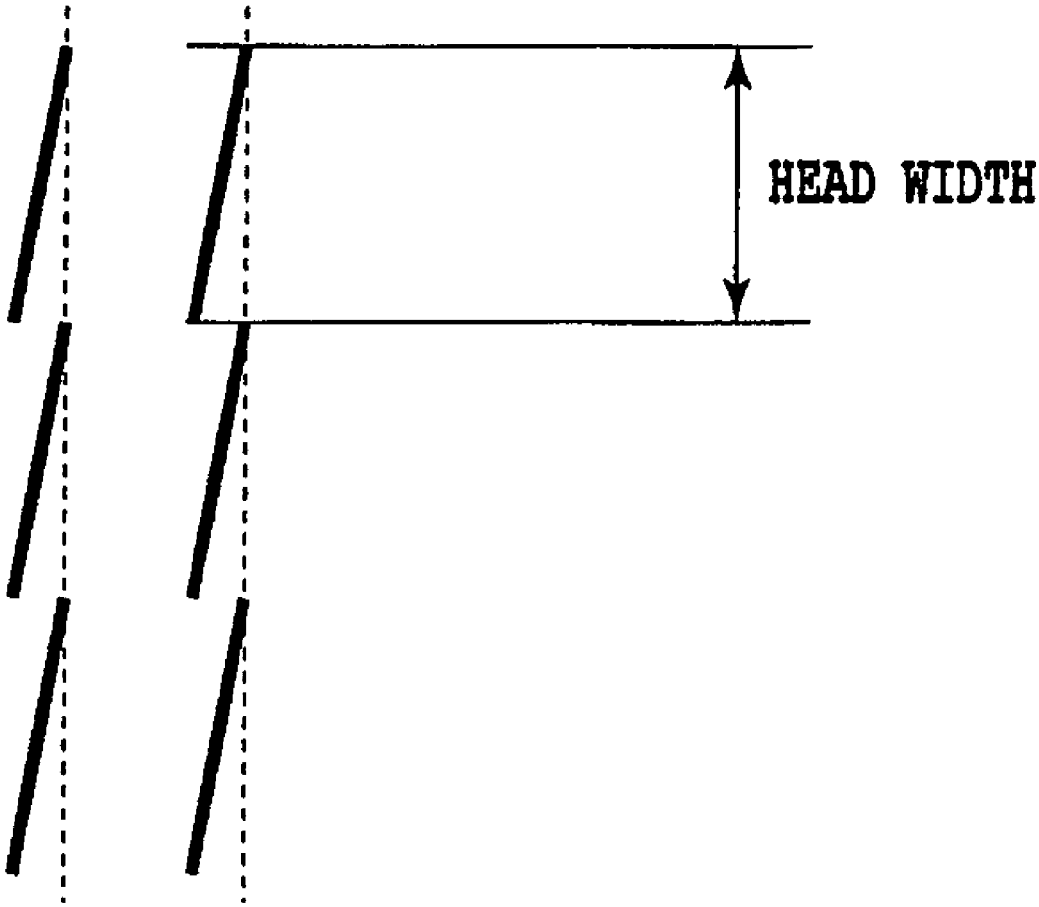
FIG. 2 is a diagram for explaining a printing head which has an inclination.
Figures 3A, 3B:
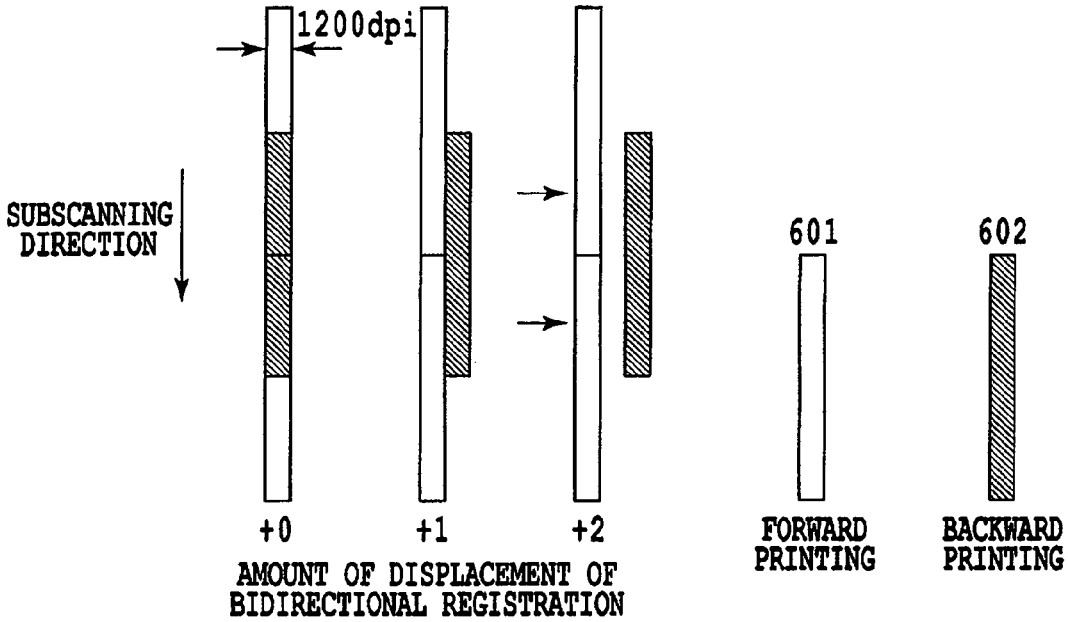
FIGS. 3A and 3B are diagrams, each showing a printing state in the multi-pass printing with the use of a printing head which is not inclined.

In recent years, some of the ink jet printing apparatuses adopt a technology to correct the inclination of the printing head so as to reduce negative effects on the image by the inclination of the printing head mentioned above for being provided. The inclination correction technology is a technology in which the timing to eject according to a data in each printing element within the printing head is shifted relatively so as to form, for instance, the ruled line as shown in FIG. 2 into a straight line, in a serial type printing apparatus. As a method to shift the ejection timing, a method to change the ejection timing of each individual printing element within the time of 1 pixel area is also known, but in order to handle the inclination of more than one pixel, a method to shift the print data corresponding to the predetermined printing element in the main scanning direction is also disclosed. For instance, the methods as described above are disclosed in Japanese Patent Application Laid-Open No. 7-309007, Japanese Patent Application Laid-Open No. 7-40551 and Japanese Patent Application Laid-Open No. 11-240143.

Figure 14:
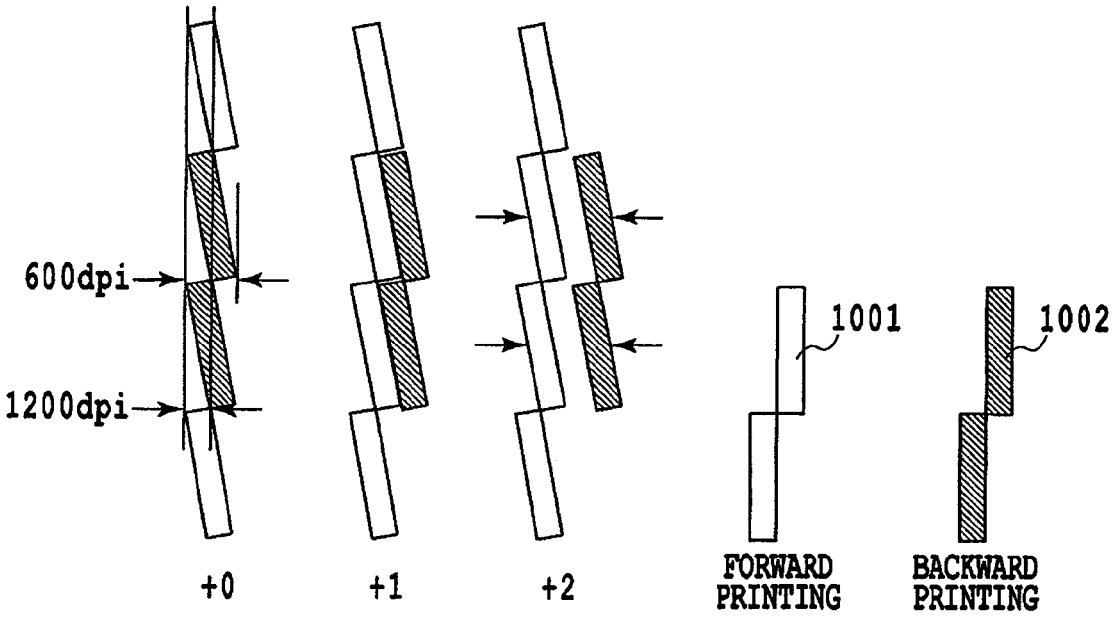
FIG. 14 is a diagram showing a state where the amount of displacement of the bidirectional registration is changed gradually with the use of a printing head to which an inclination correction is applied.

FIG. 14 is a diagram showing a state where the amount of displacement of the bidirectional registration is changed gradually with the use of the printing head to which an inclination correction is applied. The printing head applied herein includes the amount of inclination displacement of 2 pixels of 1200 dpi. And, image data of a lower half area of the printing head is shifted by 1 pixel relative to an upper half area of the printing head for the inclination correction of the printing position. By the inclination correction as described above, the inclination of the printing head is reduced from 2 pixels to 1 pixel in appearance.

Here, positive and negative values of each of the bidirectional registration and the inclination correction will be explained. As for the bidirectional registration, a direction in which a dot position printed by backward scanning moves to the right side of a paper, that is, a direction to hasten the drive timing of the backward scanning is shown as "+". Further, in the inclination correction, compared with a nozzle positioned upper edge thereof as a standard nozzle, a direction in which a nonstandard nozzle delay the drive timing in the forward scanning is shown as "+". Therefore, in FIG. 14, the bidirectional registration is changed to "+1" and "+2" and the inclination correction is "−1".

In a case where the multi-pass (two-pass) printing is performed in such a state to fluctuate the amount of displacement of the bidirectional registration gradually, when the amount of displacement of the bidirectional registration is 0, there is no displacement between an image 1001 printed in the forward scanning and an image 1002 printed in the backward scanning and both images are overlapped with each other nearly completely. As the amount of displacement of the bidirectional registration is gradually increased, the image 1001 printed in the forward scanning and the image 1002 printed in the backward scanning are gradually separated from each other, but in this example, the inclination correction is performed and thus, a difference in the amount of displacement of the bidirectional registration between the area A and the area B as in FIG. 4A does not appear. As a result of that, the banding also does not occur.

However, there are various extents (or amount) of inclinations of the printing head and the inclination amount is not always an integral multiple of a correctable unit. That is, in FIG. 14, while the smallest unit of the inclination correction is 1 pixel of 1200 dpi, the inclination amount of the printing head is just twice as much as that and thus, a preferable result as shown in the drawing can be obtained, which, however, is rare actually.

Figure 15:
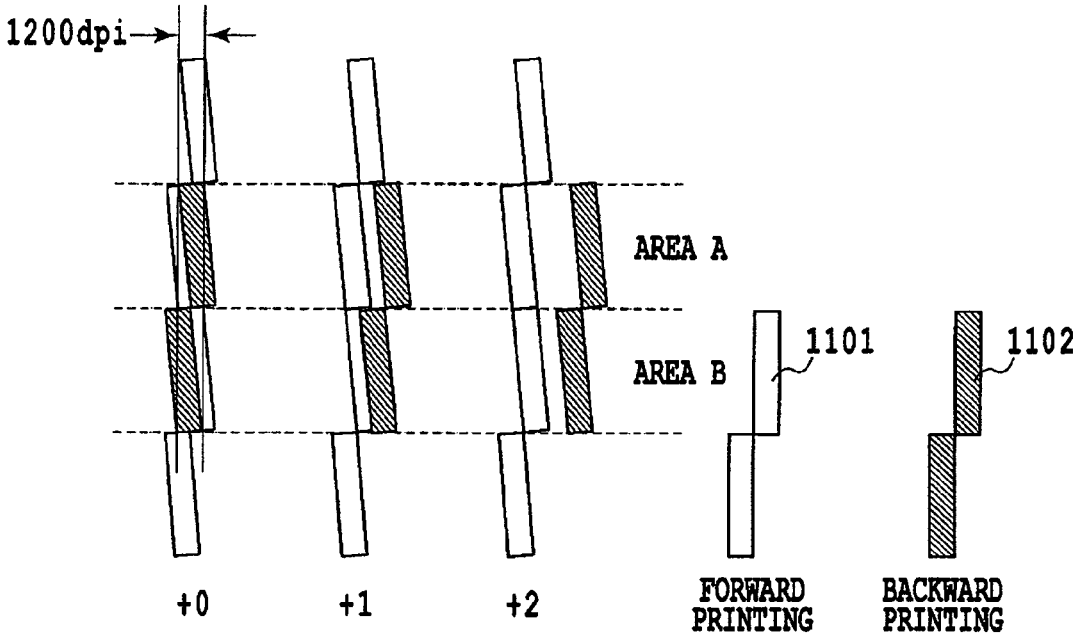
FIG. 15 is a diagram showing a state where the amount of displacement of the bidirectional registration is gradually changed with the use of a printing head to which an inclination correction is applied is changed.

FIG. 15 is a diagram showing a state with the use of the printing head of which inclination amount is 1 pixel, as in FIG. 14. When the inclination is 1 pixel, in other words, when a printing position of each of a printing element on a leading end and a printing element on a trailing end which are arranged on the printing head is deviated by 1 pixel in the main scanning direction, even if the same correction as in FIG. 14 is applied, the extent of the inclination is not changed as a result. The reason thereof is that even if the image data of the lower half area of the printing head is shifted, the amount of correction is 1 pixel and thus, the excessive correction in which the printing position is above the optimum printing position is applied.

Figures 4A, 4B:
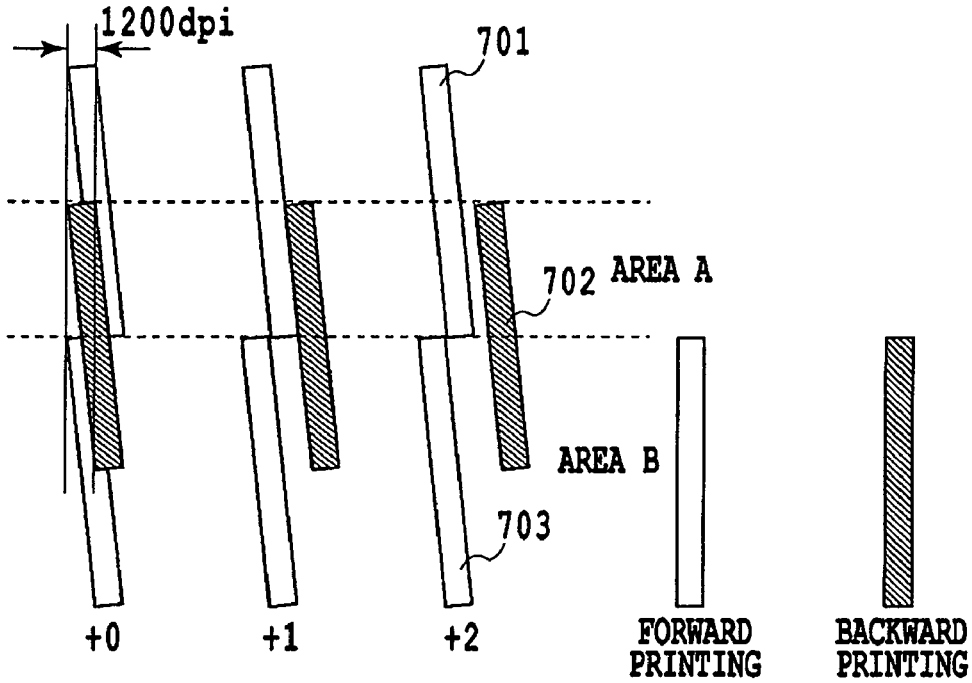
FIGS. 4A and 4B are diagrams, each showing a printing state in the multi-pass printing with the use of a printing head which is inclined.

When the multi-pass (two-pass) printing is performed in such a state to fluctuate the amount of displacement of the bidirectional registration gradually, the state becomes similar to the state in FIG. 4A explained in the embodiment 1. The reason thereof is that while the distance between the area printed in the forward scanning and the area printed in the backward scanning is relatively longer in the area A, the distance is relatively shorter in the area B. In other words, even when the inclination of the printing head is corrected, in a case where the inclination less than correction resolution remains, the banding as explained in the embodiment 1 is generated.

FIG. 16 is a diagram showing a result of how the state of each of banding and granularity is changed when a degree of inclination of the printing head is changed per pixel with the use of the ink jet printing apparatus by which the correction of inclination of the printing head can be performed per pixel. When the inclination correction functions effectively as explained in FIG. 14, the difference of dot density variations between an area A and an area B is not generated and the negative effect by the banding is not identified. As opposed to this, when the inclination correction is insufficient as explained in FIG. 15, that is, when the extent of the inclination is ±1, the difference of dot density variations between the area A and the area B is generated and the negative effect by the banding is identified.

As a result of the above, the inventors have determined that also in the ink jet printing apparatus which can carry out the inclination correction, when a slight inclination remains after the inclination correction, the present invention effectively functions.

Figure 17:
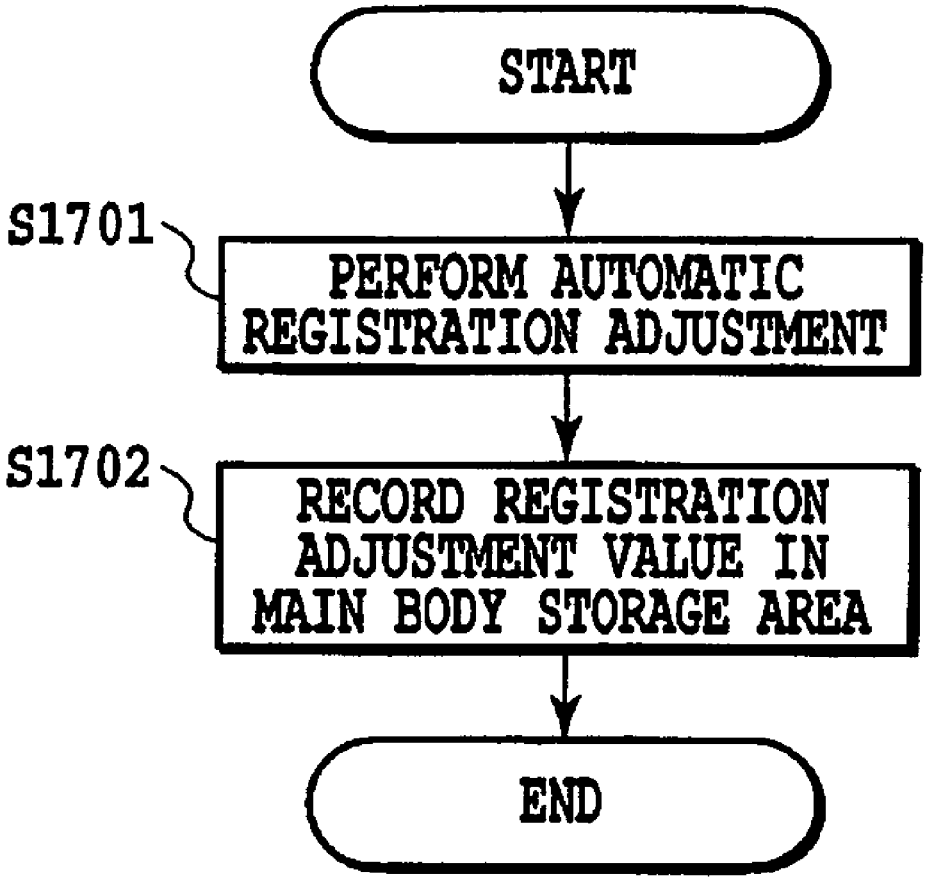
FIG. 17 is a flow chart for explaining each process when a bidirectional registration adjustment mode according to an embodiment 2 of the present invention is carried out.

FIG. 17 is a flow chart for explaining each process when the bidirectional registration adjustment mode of the embodiment is carried out. When the processing is started, initially in step S1701, an automatic registration adjustment is performed. The CPU 100 reads the pattern data for bidirectional registration adjustment stored in the ROM 101 and outputs the data to the printing medium through various types of drive means. Further, through pattern detection means equipped in the printing apparatus, a pattern printed in the printing medium is read, and an optimum value of the bidirectional registration adjustment value is determined.

In the following step S1702, the adjustment value determined in step S1701 is stored in the ROM 101 within the printing apparatus. This is the end of the bidirectional registration adjustment mode of the embodiment.

Figure 18:
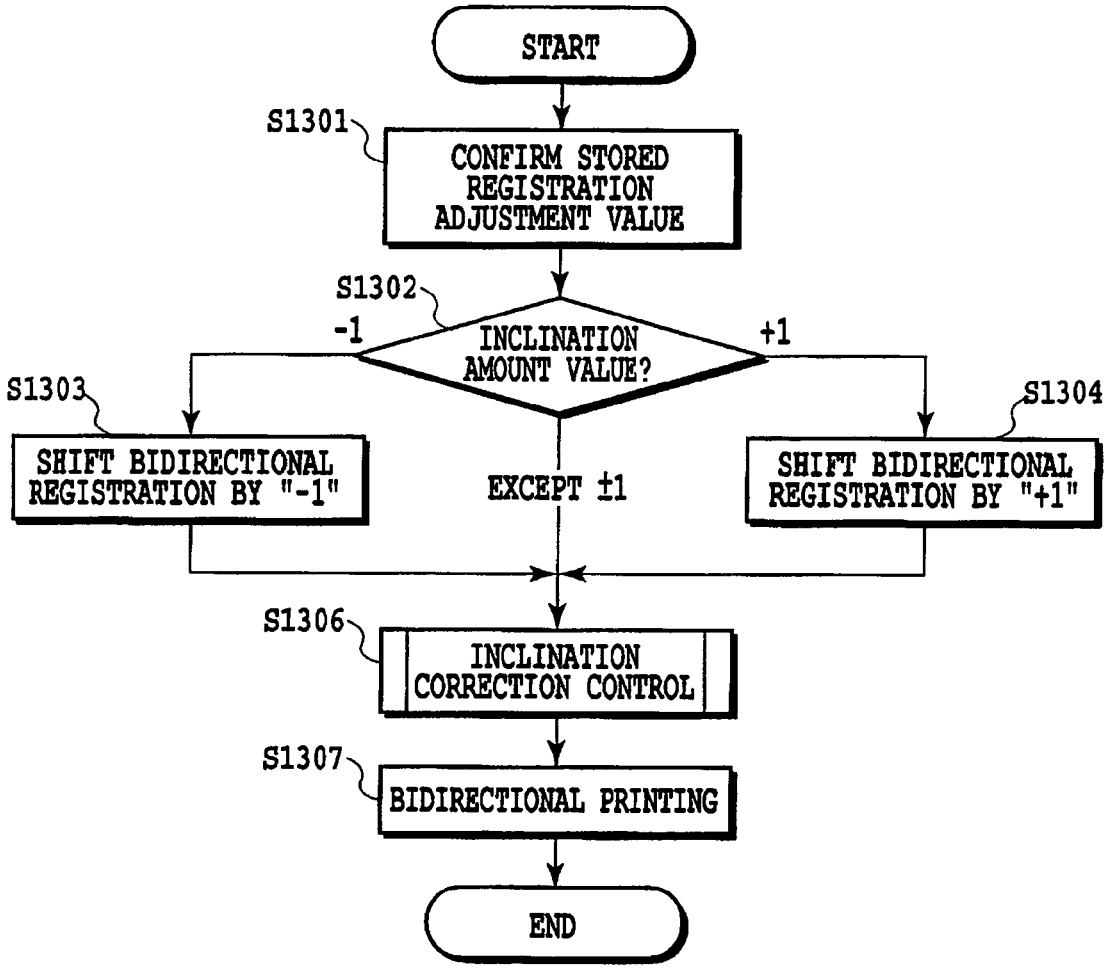
FIG. 18 is a flow chart for explaining a process to adjust a bidirectional registration in the embodiment 2.

FIG. 18 is a flow chart for explaining a process to adjust a bidirectional registration on the basis of the information stored in the ROM 101 prior to the actual image printing. When a printing instruction from the host device 200 is input, the CPU 100 first obtains the adjustment value of the bidirectional registration stored in the ROM 101 for setting (step S1301).

Next, the step proceeds to step S1302. In step S1302, the inclination amount of the printing head which is attached at the moment is determined from the information stored in the ROM 101, and according to the determination, the adjustment value set in step S1301 is corrected.

FIG. 19 is a diagram showing an amount of correction applied in response to the amount of inclination of the printing head. That is, in the embodiment, when the inclination amount is other than ±1, the preset adjustment value is not corrected and the step proceeds to step S1306. On the other hand, when the inclination amount is +1, the step proceeds to step S1304 in which +1 is applied to the adjustment value of the bidirectional registration set in step S1301. Furthermore, when the inclination amount is −1, the step proceeds to step S1303 in which −1 is applied to the adjustment value of the bidirectional registration set in step S1301. In step S1306, the inclination correction control is performed.

Figure 20:
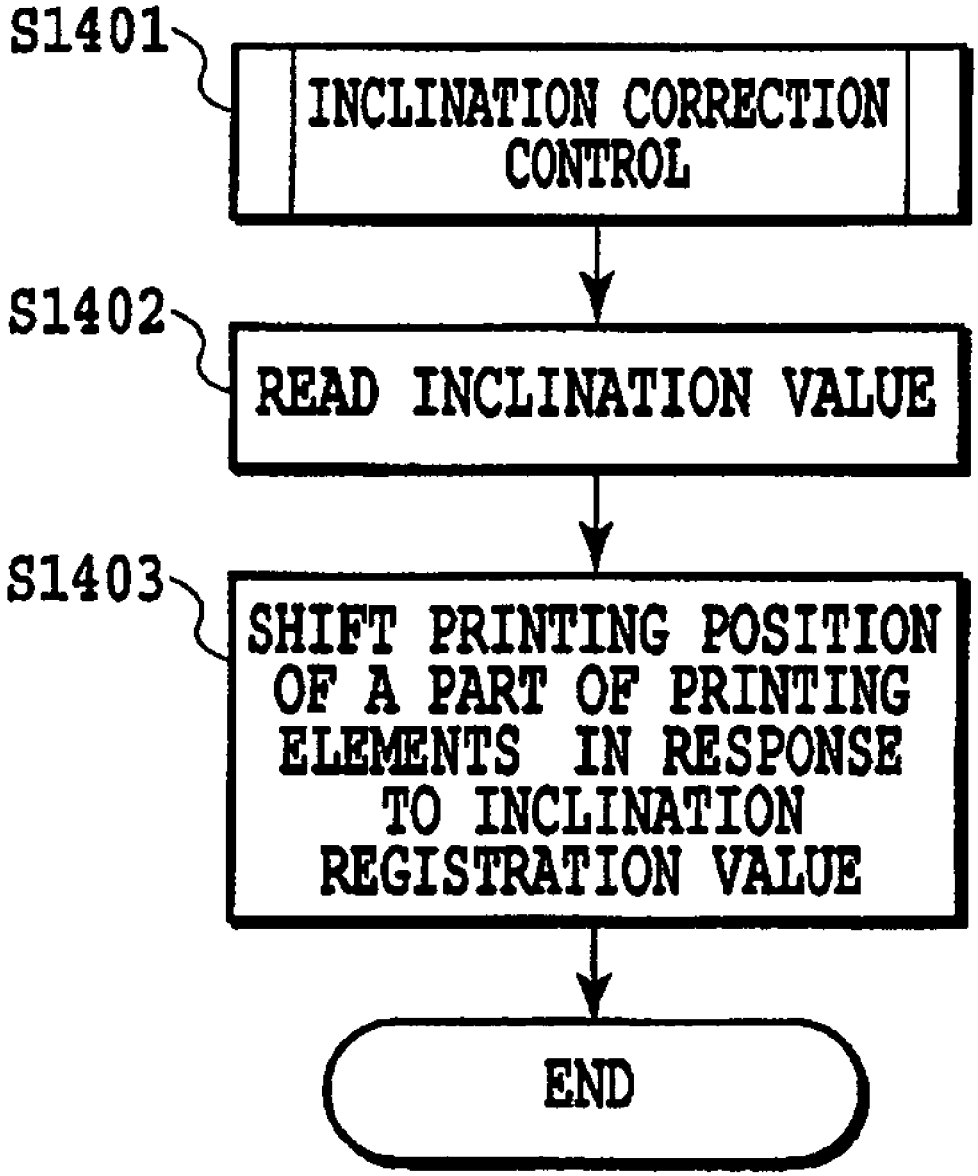
FIG. 20 is a flow chart for explaining each process when inclination correction control in the embodiment 2 is performed.

FIG. 20 is a flow chart for explaining each process when the inclination correction control in the embodiment is performed. In the embodiment, it is arranged that the inclination value of the printing head is preliminarily stored in the ROM 101 of the printing apparatus. When the inclination correction control is started, the CPU 100 primarily obtains the inclination value of the printing head stored in the ROM 101 (step S1402). In the following step S1403, the CPU 100 shifts the image data corresponding to each printing element in the main scanning direction for correcting the inclination which is obtained. This is the end of the inclination correction control.

The flow chart of FIG. 18 is referred to again. In step S1307, based on the amount of shift of image data corresponding to each printing element set in step S1306 and the bidirectional registration adjustment value set in steps S1302 to S1304, the bidirectional printing of the actual image is performed. This is the end of this processing.

FIG. 21 is a diagram for explaining an extent of each of banding and granularity when an image is printed in the embodiment, in comparison with that in FIG. 16. According to the embodiment, it is understood that compared to the result shown in FIG. 16, the extent of banding is totally improved especially in the range where the amount of displacement of the bidirectional registration and the amount of inclination of the printing head is ±1.

As described above, according to the embodiment, the adjustment amount of the bidirectional registration is corrected according to the printing state after the inclination correction and thus, it becomes possible to output an image of high quality in the bidirectional printing, totally reducing image deterioration factors such as the banding and the granularity.

Note that in the embodiment, a configuration where the amount of inclination of the printing head is stored in the main body ROM preliminarily is explained, but it is possible to realize the embodiment even if the embodiment does not include such a form. For instance, as in the case of the embodiment 1, the embodiment may include a configuration where a pattern of detecting the amount of inclination of the printing head along with the bidirectional registration adjustment pattern is output to be read by the detection means. Further, when the printing head is one of a cartridge type as explained in FIG. 7, exchanging the printing head to the printing apparatus is also considered and a memory in which the amount of inclination is stored may be equipped in the printing head.

Furthermore, in the above description, it is arranged that the image data corresponding to a plurality of the printing elements is shifted in the main scanning direction, and thus the inclination correction is carried out per pixel of 1200 dpi, but the effect of the embodiment is not limited to the case where such an inclination correction method is applied. For instance, as described in Japanese Patent Application Laid-Open No. 7-309007 and Japanese Patent Application Laid-Open No. 7-40551, even when a method in which an inclination amount less than 1 pixel is corrected by the displacement of the ejection timing among a plurality of printing elements each other in the time corresponding to 1 pixel is adopted, it is possible to function the present invention effectively. No matter which method of the inclination correction is adopted, in the case where a slight inclination remains after the correction, which is a factor causing the banding, the present invention can be effective.

However, when a method of shifting the drive timing each other is adopted as in Japanese Patent Application Laid-Open No. 7-309007 and Japanese Patent Application Laid-Open No. 7-40551, a more complicated drive signal transmission configuration to a printing element is required and an increase of memories equipped in the main body, a decrease in the printing speed and the cost increase accompanied by the complication of the drive control may be caused. Therefore, the method as explained in the embodiment is applied to the inclination correction, and simultaneously, to an inclination less than 1 pixel, the negative effect of banding generated by this is made inconspicuous to the greatest extent possible, by which as a result, the present invention functions more effectively.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

This application claims priority from Japanese Patent Application No. 2005-200156 filed Jul. 8, 2005, which is hereby incorporated by reference herein.

What is claimed is:

1. A printing apparatus for forming an image by bidirectional scanning of a printing element array in a direction intersecting a conveying direction of a printing medium, the printing element array including a plurality of printing elements arranged in the conveying direction each of which discharges an ink on the printing medium, comprising:

means for obtaining a first adjustment value for adjusting a relative displacement between a printing position of forward scanning and a printing position of backward scanning and a second adjustment value for adjusting a displacement of a printing position due to an inclination of the printing element away to the conveying direction;

correcting means for correcting the first adjustment value in response to a direction of the inclination of the printing element array only in case the absolute value of the second adjustment value is larger than a predetermined value which is other than zero; and means for adjusting the relative displacement and the displacement of the printing position caused by the inclination of the printing element array based on the first adjustment value corrected by said correcting means and the second adjustment value.

2. The printing apparatus according to claim 1 further comprising:

a controller which controls the printing element array to print a test pattern for obtaining the first adjustment value and a test pattern for obtaining the second adjustment value; and means for detecting the test patterns.

3. The printing apparatus according to claim 1, wherein the second adjustment value is a value for adjusting a printing position by one pixel.

4. A printing position control method of a printing apparatus for forming an image by bidirectional scanning of a printing element array in a direction intersecting a conveying direction of a printing medium, the printing element array including a plurality of printing elements arranged in the conveying direction each of which discharges an ink on the printing medium, comprising the steps of:

obtaining a first adjustment value for adjusting a relative displacement between a printing position of forward scanning and a printing position of backward scanning and a second adjustment value for adjusting a displacement of a printing position due to an inclination of the printing element array to the conveying direction;

correcting the first adjustment value in response to a direction of the inclination of the printing element array only in case the absolute value of the second adjustment value is larger than a predetermined value which is larger than zero; and adjusting the relative displacement and the displacement of a printing position caused by the inclination of the printing element array based on the first adjustment value corrected by said correcting step and the second adjustment value.

* * * * *